US009470109B2

(12) United States Patent
Choi et al.

(10) Patent No.: US 9,470,109 B2
(45) Date of Patent: Oct. 18, 2016

(54) TURBINE BLADE INSERTION TOOL

(71) Applicant: Siemens Energy, Inc., Orlando, FL (US)

(72) Inventors: Jae Young Choi, Murrysville, PA (US); Ronald H. Lovett, Irwin, PA (US)

(73) Assignee: Siemens Energy, Inc., Orlando, FL (US)

( * ) Notice: Subject to any disclaimer, the term of this patent is extended or adjusted under 35 U.S.C. 154(b) by 322 days.

(21) Appl. No.: 14/173,845

(22) Filed: Feb. 6, 2014

(65) Prior Publication Data

US 2014/0237820 A1 Aug. 28, 2014

Related U.S. Application Data

(60) Provisional application No. 61/770,706, filed on Feb. 28, 2013.

(51) Int. Cl.
*F01D 5/30* (2006.01)
*F01D 25/28* (2006.01)

(52) U.S. Cl.
CPC ..... *F01D 25/285* (2013.01); *F01D 5/3007* (2013.01); *F05D 2230/60* (2013.01); *Y10T 29/49321* (2015.01); *Y10T 29/53961* (2015.01)

(58) Field of Classification Search
CPC ..... F01D 25/285; F01D 5/3007; F05D 2230/60; Y10T 29/53961; Y10T 29/49321
See application file for complete search history.

(56) References Cited

U.S. PATENT DOCUMENTS 3,681,837 A * 8/1972 Franklin ..... B23P 19/04 29/453

* cited by examiner

*Primary Examiner* — Richard Chang

(57) ABSTRACT

Turbine blade insertion tool (20) facilitates supported vertical and lateral alignment of a turbine blade root (18) and corresponding rotor slot (14) from under a suspended rotor (12). The blade lift fixture (46) slidably retains the blade root while manually biasable slide (38) provides supported relative vertical alignment between the blade root and rotor slot Supported lateral root/slot alignment is provided by manually swinging the blade lift fixture (46) on three-dimensional motion capable swivel eye (50) and corresponding lift hook (44) that are coupled to the slide (38). The blade insertion tool (20) optionally is maneuverable on swivel rollers (24) under the rotor (12).

16 Claims, 4 Drawing Sheets

TURBINE BLADE INSERTION TOOL

PRIORITY CLAIM

This application claims the benefit of priority of U.S. provisional patent application entitled "Turbine Blade Insertion Tool" filed Feb. 28, 2013 and assigned Ser. No. 61/770,706, the entire contents of which is incorporated by reference.

TECHNICAL FIELD

The invention relates to apparatus and methods for installing a turbine blade in a turbine rotor by supported and guided insertion of the turbine blade root into a corresponding rotor slot.

BACKGROUND ART

A turbine blade is inserted into a rotor by concentrically aligning and slidably inserting a male blade root within a tightly conforming corresponding female slot in the rotor while the rotor is suspended in a fixture. Given the physical weight and length of a rotor blade, it is challenging to align corresponding blade root and rotor slot structures with sufficient precision to slide the blade into its inserted position within the rotor.

Past known insertion methods and tools have included manual blade manipulation by human operators using portable hand dollies; robotic blade manipulation arms in factory manufacturing or service facilities rather than field environments; pneumatic table blade lifts and overhead cranes or equivalent manual hoists Each of the known blade insertion methods and tools has disadvantages in manufacturing or service facilities or in field installation sites.

Manual blade manipulation by human operators with wheeled dollies and other non-supported, muscle-manipulated tools is physically exhausting to the operators, as they must physically lift the blade into vertical alignment position with the rotor while simultaneously laterally aligning the blade root and rotor slot. Unsupported manual blade lifting and vertical/lateral alignment manipulation also risks potential blade damage if the blade slips or drops due to mishandling error.

Robotic blade manipulation arms are helpful for constructing or maintaining turbine blades that are removed from a rotor, but their relatively large size and limited range of offset blade manipulation motion that otherwise might risk tipping of robotic tool due to the heavy offset blade load makes them impractical for use as a blade insertion tool.

As with robotic blade manipulation arms, air-powered table-type lifts have relatively large footprints that are more suited for blade installation in manufacturing or service sites but are often too large for practical use in turbine field sites. Vertical position of the pneumatic table changes during blade loading and unloading, which potentially shifts the table's center of gravity. Loading and unloading weight on the pneumatic table also imparts oscillatory motion on the table, making lateral blade root/rotor slot alignment difficult.

Overhead cranes and hoists require insertion of the blades at a 12 o'clock elevated radial position on the suspended rotor, rather than at a 6 o'clock ground-level position, because the suspended rotor lack of vertical clearance interferes with crane or hoist positioning from under the rotor. It is more difficult for human operators to install blades into a rotor from a 12 o'clock elevated position as compared to floor elevation installation.

SUMMARY OF INVENTION

Some embodiments of a turbine blade insertion tool of the invention facilitate supported vertical and lateral alignment of a turbine blade root and a corresponding rotor slot from under a suspended rotor. The insertion tool includes a vertically supported blade lift fixture that slidably retains the blade root while manually biasable slide that is coupled to the blade fixture provides supported relative vertically adjustable alignment between the blade root and rotor slot. Supported lateral root/slot alignment is provided by manually swinging the blade lift fixture on a three-dimensional motion-capable swivel eye and corresponding lift hook that are both coupled to the manually adjustable vertical slide. Some embodiments of the blade insertion tool of the invention have swivel rollers that facilitate manual maneuvering under the rotor.

Some embodiments of the invention feature a method for inserting a turbine blade root into a corresponding downwardly oriented turbine rotor slot of a vertically suspended rotor. A blade insertion tool is provided, having a man-maneuverable base and a vertical column projecting upwardly from the base having a distal end height adapted for passage under a vertically suspended rotor. The blade insertion tool has a blade lift fixture defining a cavity for slidable receipt and retention of a blade root therein that is coupled to the distal end of the vertical column by a three-axis degree of freedom joint. The blade insertion tool is used by slidably inserting and retaining a turbine blade root of a turbine blade into the blade lift fixture and raising the blade lift fixture with the turbine blade suspended therefrom. The blade lift fixture is coupled to the vertical column distal end with the joint, thereby vertically suspending and supporting the blade with the blade insertion tool. The blade insertion tool is maneuvered under the suspended rotor and thereafter coaxially aligning the blade root and rotor slot by maneuvering the suspended blade and the blade lift fixture. Once the blade root and rotor slot are aligned the blade root is slidably inserted at least partially into the rotor slot and the blade root is released from the blade lift fixture. Thereafter the blade root continues to be slid into the rotor slot until the blade is in a fully seated position on the rotor.

Other embodiments of the invention feature a blade insertion tool apparatus including a man-maneuverable base and a vertical column projecting upwardly from the base having a distal end height adapted for passage under a vertically suspended rotor. A blade lift fixture defining a cavity for slidable receipt and retention of a blade root therein is selectively coupled to the distal end of the vertical column by a three-axis degree of freedom joint. Some embodiments of the apparatus include one or more of the three degree of freedom joint having a lift hook and a swivel eye; and/or a biasing mechanism having threaded screws projecting into the blade lift fixture cavity, for pinch restrain the turbine blade root when biased into abutting contact therewith; and/or the man-maneuverable base having swivel rollers and spring-biased ball casters for maintaining tilt stability of the blade insertion tool during rolling maneuvers over uneven surfaces.

The respective features of embodiments of the present invention may be applied jointly or severally in any combination or sub-combination by those skilled in the art.

BRIEF DESCRIPTION OF DRAWINGS

The teachings of the present invention can be readily understood by considering the following detailed description in conjunction with the accompanying drawings, in which.

To facilitate understanding, identical reference numerals have been used, where possible, to designate identical elements that are common to the figures.

DESCRIPTION OF EMBODIMENTS

After considering the following description, those skilled in the art will clearly realize that the teachings of the present invention can be readily utilized in a turbine blade insertion tool of the invention, embodiments of which facilitate supported vertical and lateral alignment of a turbine blade root and a corresponding rotor slot from under a suspended rotor. The insertion tool includes a vertically supported blade lift fixture that slidably retains the blade root while manually biasable slide that is coupled to the blade fixture provides supported relative vertically adjustable alignment between the blade root and rotor slot. Supported lateral root/slot alignment is provided by manually swinging the blade lift fixture on a three-dimensional motion-capable swivel eye and corresponding lift hook that are both coupled to the manually adjustable vertical slide. Some embodiments of the blade insertion tool of the invention have swivel rollers that facilitate manual maneuvering under the rotor.

Figure 1:
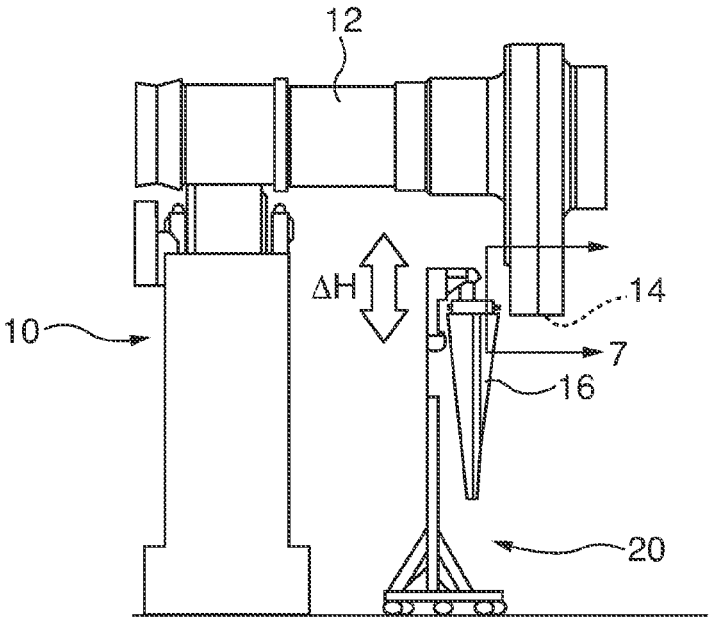
FIG. 1 is a side elevational view of an embodiment of a blade installation tool of the invention used to align and install a turbine blade into a turbine rotor.

FIG. 1 shows support stand 10 upon which rests a vertically suspended rotor 12, the latter having a plurality of radially aligned rotor slots 14 that are adapted for slidable receipt of a corresponding rotor root 18 of a turbine blade 16. A blade insertion tool 20 that is constructed in accordance with an embodiment of the invention slidably retains the rotor root 18 and thus vertically supports the entire rotor blade 16. The embodiment of the blade insertion tool 20 provides for supported manual height adjustment ΔH and supported manual orientation of the tool under the rotor 12, for ground level insertion of the blade at a convenient 6 o'clock radial rotor position. Ground level insertion is more convenient for the blade installers than requiring them to utilize scaffolding or ladders that would be otherwise necessary for insertion of a turbine blade at an elevated 12 o'clock rotor position.

Figure 2:
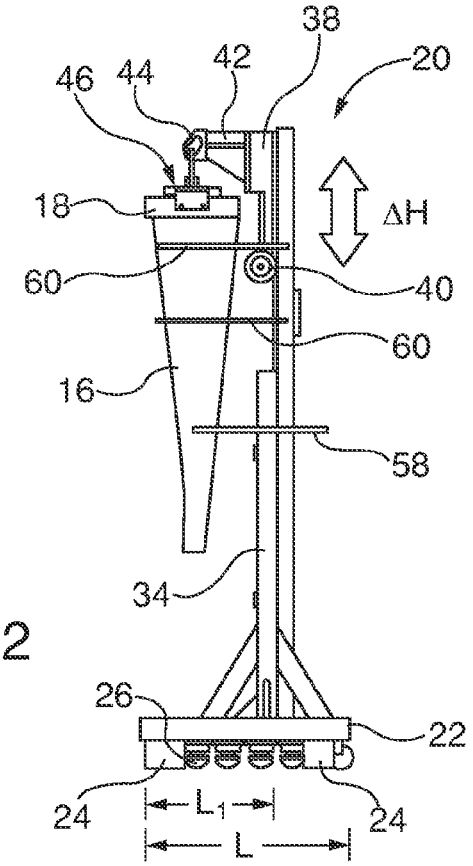
FIG. 2 is a side elevational view of the blade installation tool of FIG. 1.
Figure 3:
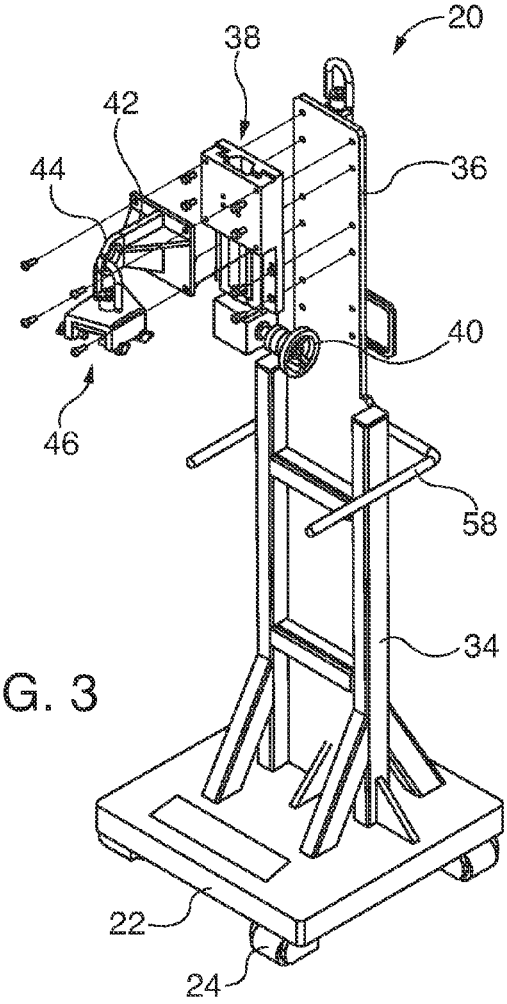
FIG. 3 is an exploded perspective view of the blade installation tool of FIG. 1.
Figure 4:
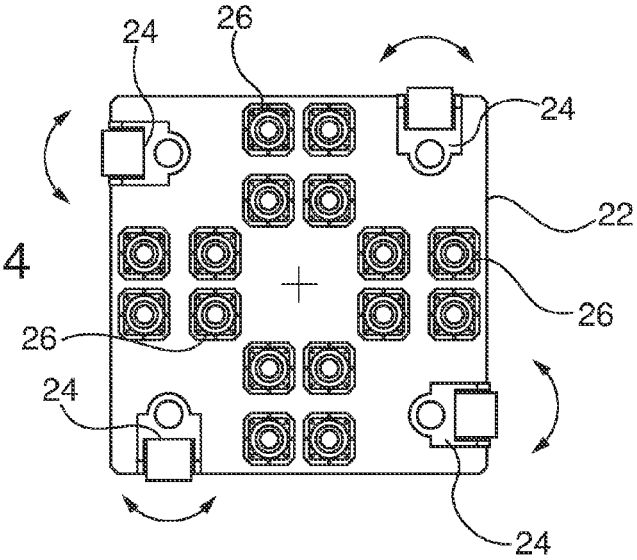
FIG. 4 is a bottom plan view of the blade installation tool of FIG. 1.
Figure 5:
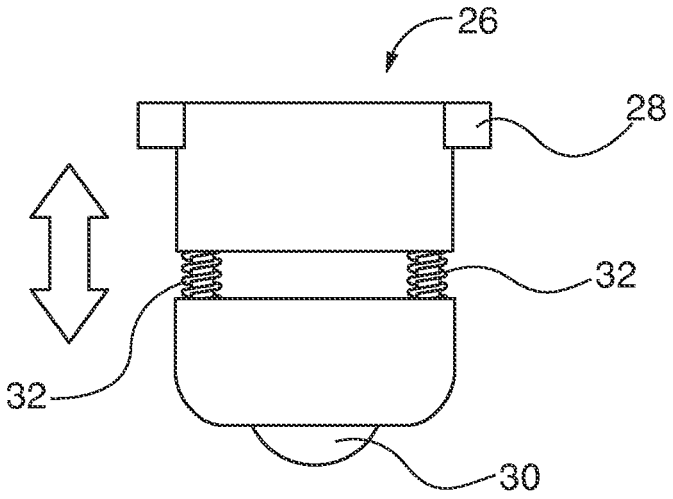
FIG. 5 is a detailed elevational view of a ball caster assembly of the blade installation tool of FIG. 4.

Referring generally to FIGS. 2-4, the blade insertion tool 20 has a manually moveable base 22 with corner-mounted swivel rollers 24 that provide for lateral stability and tipping resistance when transporting a turbine blade 16. Additional symmetrically mounted spring-loaded ball caster assemblies 26 provide additional structural stability to the blade insertion tool 20 and conform to uneven floor surfaces. As shown in FIG. 5, each ball caster assembly 26 is coupled to the base 22 by ball caster mount block 28. A ball caster 30 provides single-point contact with the corresponding floor surface and is in turn coupled to the caster mount block 28 by captured compression springs 32. The springs 32 and ball caster 30 single point contacts distribute weight load of the blade insertion tool 20 and the lifted turbine blade 16 load over a larger surface area compared than the swivel rollers 24 alone The array of ball caster assemblies 26 provide for vertical conformance with uneven floor surfaces but also provide lateral stability when maneuvering the blade mounting tool 20 structure, due to the array of single contact points along the base 22

A vertical support structure column 34, shown as constructed from segments of tubular material, is coupled to the base 22, along with vertically-oriented backing plate 36. Together they vertically support the suspended weight of the turbine blade 16. The support column 34 and vertically-oriented backing plate 36 are affixed to the base 22 in a lateral relative position $L_1$ that is chosen to resist tipping of the blade insertion tool 20 due to the offset retention of the blade 16 weight. The blade weight's tipping moment is resisted by the portion of the base 22 of length $L_1$ while the remaining portion of the base on the opposite side from the suspended blade resists tipping in that direction. A relative ratio of $L_1$:L of 2:3 is satisfactory to inhibit suspended blade tipping of the blade insertion tool 20.

Vertical height adjustment ΔH for the suspended turbine blade 16 is provided by manually-manipulated dovetailed slide 38, which is of known and commercially available structure The dovetailed slide 38 is often constructed with a machine screw and pinion that is manipulated by turning the handle 40, though a motor- or hydraulically-driven power source may be substituted for the manual drive mechanism. A base portion of the slide 38 is coupled to the backing plate 36 while the translatable (driven) portion of the slide is coupled to a slide back plate 42. Lift hook 44, advantageously including but not requiring a snap link toggle as shown, is coupled to the slide back plate 44, such as by welding.

Figure 6:
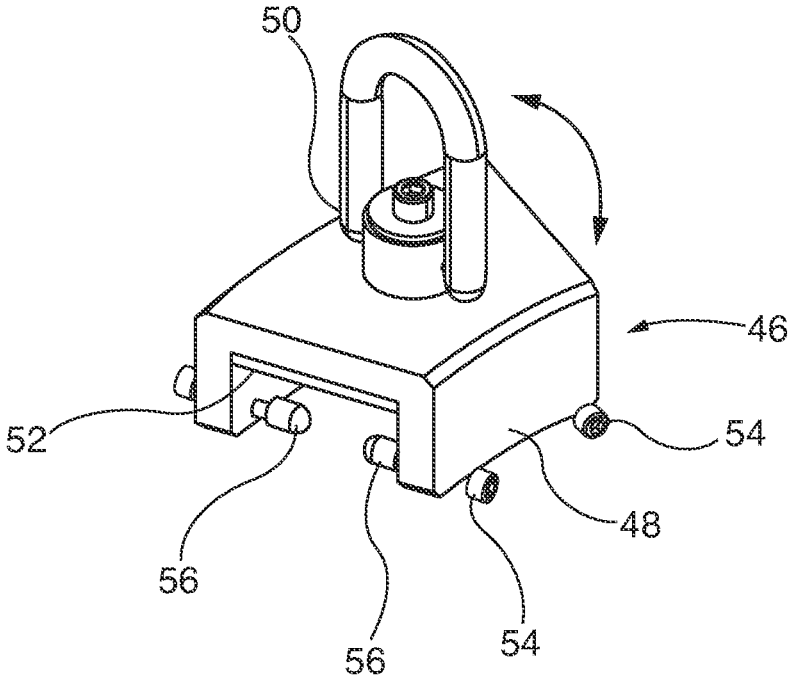
FIG. 6 is a perspective view of the blade lift fixture used to retain a turbine blade root of the blade installation tool of FIG. 1.
Figure 7:
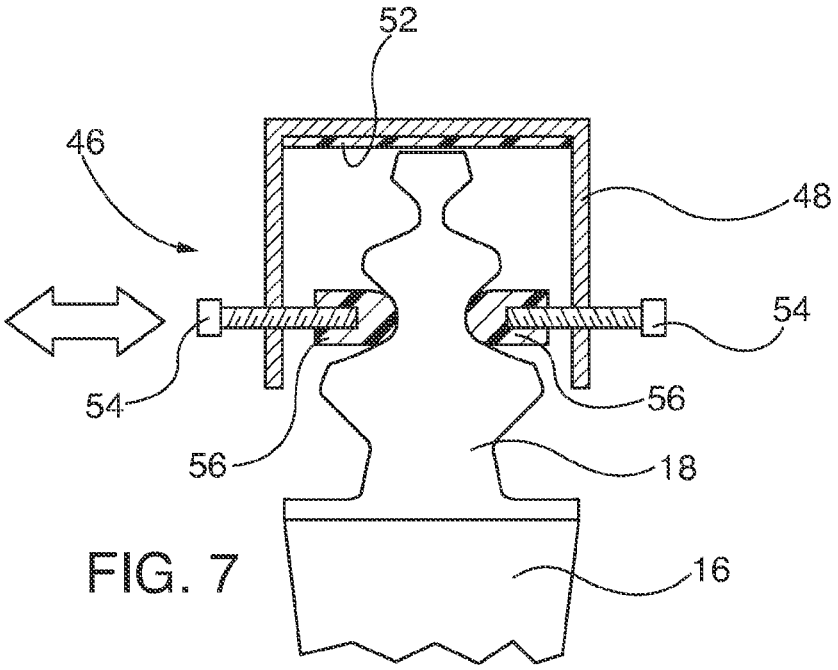
FIG. 7 is a vertical cross-sectional view of the blade lift fixture taken along 7-7 of FIG. 1.

Referring to FIGS. 3, 6 and 7, blade lift fixture 46 slidably retains the blade root 18, and as shown has a generally sector-shaped plan profile that conforms to the blade root profile. The blade lift fixture 46 has a blade lifting body 48 of a generally C-shaped cross section that is coupled to the lift hook 44 by swivel eye 50 Thus by the swivel eye 50 and lift hook 44 attachment to the slide back plate 42 the blade lift fixture 46 is capable of a supported three-dimensional range of motion relative to the rest of the blade insertion tool 20 structure. This supported three-dimensional range of motion facilitates small motion rocking, tipping and twisting of the blade root 18 axis relative to the rotor slot 14 axis for precise final relative co-axial alignment while the blade installation tool 20 supports the blade weight. A human operator or operators are capable of the fine manipulation alignment of the blade relative to the rotor and initial insertion of the blade root 18 into the rotor slot 14 without exerting the significant muscular effort that would be otherwise necessary to support the entire blade weight.

Figure 8:
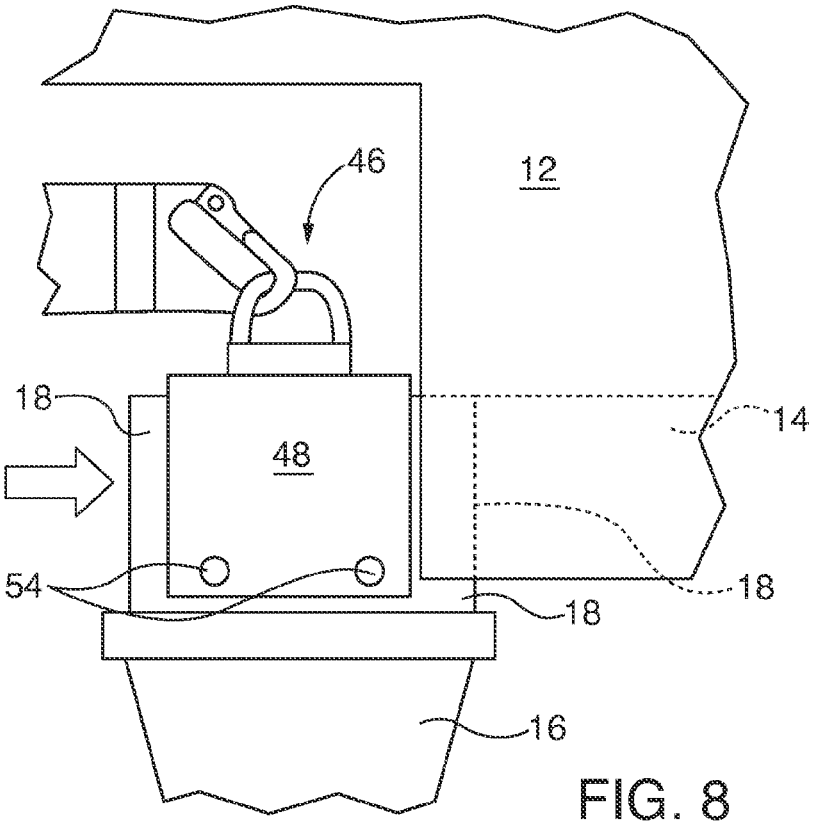
FIG. 8 is a detailed side elevational view of the blade installation tool of FIG. 1 after alignment of the blade relative to the rotor slot and subsequent partial insertion of the blade root into its corresponding aligned rotor slot.

A blade protective pad 52, constructed of a resilient material, such as polyurethane foam, is interposed between the lifting body upper interior surface and the blade root Concave depressions formed within the blade root 18 profile receive a plurality of corresponding inwardly directed blade retention projections, which as shown in the embodiments herein are cap screws 54 that are retained within mating threads formed in the blade lifting body Resilient blade protective caps 56 cover male projecting ends of each cap screw 54 to avoid potential blade damage that might otherwise be caused by direct metal-to-metal contact between the screws and the blade root. The cap screws 54 optionally are tightened lightly in contact with the blade root for a "pinch-tight" fit, so that the blade 16 is retained within the blade lift fixture 46 during its transport on the blade insertion tool 20 until co-axial relative alignment is achieved with the rotor slot 14. Grip handle 58 facilitates manual movement of the blade removal tool 20 for achieving blade 16 and rotor 12 relative alignments under the rotor, while optional blade retention straps 60 inhibit suspended blade swinging on the three-dimensional range of motion joint formed between the lift hook 44 and the swivel eye 50. As shown in FIG. 8, after relative blade 16/rotor 12 alignment is achieved and the blade root 18 is partially inserted into the rotor slot 14, the cap screws 54 are loosened to allow sliding of the blade 16 out of the blade lift fixture 46

Although various embodiments that incorporate the teachings of the present invention have been shown and described in detail herein, those skilled in the art can readily devise many other varied embodiments that still incorporate these teachings The invention is not limited in its application to the exemplary embodiment details of construction and the arrangement of components set forth in the description or illustrated in the drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass direct and indirect mountings, connections, supports, and couplings. Further, "connected" and "coupled" are not restricted to physical or mechanical connections or couplings.

What is claimed is:

1. A method for inserting a turbine blade root (18) of a turbine blade into a corresponding downwardly oriented turbine rotor slot (14) of a vertically suspended rotor (12), comprising:

providing a blade insertion tool (20) having:

a man-maneuverable base (22), a vertical column (34, 36) projecting upwardly from the base having a distal end height adapted for passage under the vertically suspended rotor, a blade lift fixture (46) defining a cavity (48) for slidable receipt and retention of the turbine blade root, therein, and a three-axis degree of freedom joint (44, 50) for selectively coupling the distal end of the vertical column and the blade fixture;

slidably inserting and retaining the turbine blade root into the blade lift fixture;

raising the blade lift fixture with the turbine blade suspended there from;

coupling the blade lift fixture and the vertical column distal end with the joint, thereby vertically suspending and supporting the blade with the blade insertion tool;

maneuvering the blade insertion tool under the vertically suspended rotor and coaxially aligning the turbine blade root and rotor slot by maneuvering the suspended blade and the blade lift fixture;

sliding the turbine blade root at least partially into the rotor slot;

releasing the turbine blade root from the blade lift fixture; and continue sliding the turbine blade root into the rotor slot until the blade is in a fully seated position on the rotor.

2. The method of claim 1, further comprising:

providing the vertical column with a lift mechanism (38, 40) for selectively adjusting height of the suspended turbine blade root for vertical alignment with the rotor slot; and selectively adjusting vertical height of the suspended blade and vertically aligning the turbine blade root with the rotor slot.

3. The method of claim 1, further comprising:

wherein the three degree of freedom joint includes a selectively mating lift hook (44) and swivel eye (50); and selectively coupling the blade lift fixture to the vertical column by engaging the lift hook and swivel eye.

4. The method of claim 1, further comprising:

coupling to the blade lift fixture a biasing mechanism (54, 56) for selectively pinch-restraining the turbine blade root therein; and engaging the biasing mechanism to pinch-restrain the turbine blade root in the blade lift fixture when maneuvering the turbine blade with the blade installation tool.

5. The method of claim 4, the biasing mechanism comprising threaded screws (54) projecting into the blade lift fixture cavity (48) that pinch restrains the turbine blade root when biased into abutting contact therewith.

6. The method of claim 1, the man-maneuverable base comprising swivel (24) rollers and spring-biased ball casters (26) for maintaining tilt stability of the blade insertion tool during rolling maneuvers over uneven surfaces.

7. The method of claim 6, the vertical column oriented on the base in a manner to resist offset weight tipping forces created when the blade is coupled to the vertical column distal end ($L_1$).

8. The method of claim 1, further comprising resisting suspended blade swinging during blade insertion tool maneuvering by coupling retention straps (60) to the blade and the blade insertion tool.

9. A blade insertion tool apparatus (20), comprising:

a man-maneuverable base (22), a vertical column (34, 36) projecting upwardly from the base having a distal end height adapted for passage under a vertically suspended rotor, a blade lift fixture (46) defining a cavity (48) for slidable receipt and retention of a turbine blade root, therein, a three-axis degree of freedom joint (44, 50) for selectively coupling the distal end of the vertical column and the blade fixture, and first and second biasing mechanisms (54,56) that are moveable toward the turbine blade root for selectively pinch-restraining the turbine blade root in the blade fixture cavity (48).

10. The apparatus of claim 9, further comprising a lift mechanism (38, 40) for selectively adjusting height of a suspended turbine blade root for vertical alignment with the rotor slot.

11. The apparatus of claim 9, the three degree of freedom joint comprising a lift hook (44) and a swivel eye (50).

12. The apparatus of claim 9, wherein the first and second biasing mechanisms each include threaded screws (54) projecting into the blade lift fixture cavity (48) that pinch restrain the turbine blade root when biased into abutting contact therewith.

13. The apparatus of claim 9, the man-maneuverable base further comprising swivel rollers (24) and spring-biased ball casters (26) for maintaining tilt stability of the blade insertion tool during rolling maneuvers over uneven surfaces.

14. The apparatus of claim 9, further comprising the vertical column oriented on the base in a manner to resist offset weight tipping forces created when the blade is coupled to the vertical column distal end ($L_1$).

15. The apparatus of claim 9, further comprising retention straps (60) coupled to the blade and the blade insertion tool for resisting suspended blade swinging during blade insertion tool maneuvering.

16. The apparatus of claim 9, further comprising a manual or machine powered dovetail slide lift mechanism (38, 40) for selectively adjusting height of a suspended turbine blade root for vertical alignment with the rotor slot.

* * * * *